United States Patent [19]

Tiitinen et al.

[11] 4,178,172

[45] Dec. 11, 1979

[54] PROCESS FOR THE PRODUCTION OF EXTRA FINE COBALT POWDER

[75] Inventors: Heikki A. Tiitinen, Ulvila; Jussi K. Rastas, Pori; Matti J. Hamalainen, Kokkola; Tom O. Niemi, Oja, all of Finland

[73] Assignee: Outokumpu Oy, Helsinki, Finland

[21] Appl. No.: 921,365

[22] Filed: Jul. 3, 1978

[30] Foreign Application Priority Data

Jul. 15, 1977 [FI] Finland ..... 2209/77

[51] Int. Cl.[2] ..... C22B 23/02

[52] U.S. Cl. ..... 75/0.5 BA; 75/119

[58] Field of Search ..... 75/0.5 BA, 0.5 AA, 108, 75/119, 82

[56] References Cited

U.S. PATENT DOCUMENTS

| | | | |
|---|---|---|---|
| 1,226,945 | 5/1917 | Burchenal | 75/82 |
| 2,749,235 | 6/1956 | Roy | 75/119 |
| 2,793,111 | 5/1957 | Shackmann et al. | 75/82 |
| 3,975,217 | 8/1976 | Kunda et al. | 75/119 X |
| 4,093,450 | 6/1978 | Doyle et al. | 75/0.5 BA |

*Primary Examiner*—G. Ozaki

*Attorney, Agent, or Firm*—Brooks, Haidt, Haffner & Delahunty

[57] ABSTRACT

Extra fine cobalt powder is manufactured by pyrolysing a cobalt (III)hexammine salt and then reducing the obtained oxide.

8 Claims, No Drawings

PROCESS FOR THE PRODUCTION OF EXTRA FINE COBALT POWDER

BACKGROUND OF THE INVENTION

The present invention relates to a process for the production of an extra fine cobalt powder, whereby a finely-divided, uniformly-grained and carbon-free cobalt powder can be produced for powder metallurgical purposes.

In powder metallurgy, especially in the hard metal industry, precise requirements are set for the cobalt powder used. The cobalt powder used by he hard metal industry must be finely-divided, with an average grain size of 1-2 μm and with a specific surface area of over 10,000 $cm^2/g$. Impurities C, Fe, Mn, S, Na, Ca and Mg must not exceed 0.03%. In addition it is required that the cobalt powder have a certain crystal form, grindability and activity in sintering. Its oxygen content must be constant, in general less than 0.5%.

So far the most commonly used process for the production of the extra fine cobalt powder used by the hard metal industry is to decompose cobalt oxalate in a hydrogen atmosphere at about 500° C. The initial material in the process is a cobalt chloride solution, from which cobalt oxalate is precipitated by means of either oxalic acid or ammonium oxalate.

Cobalt oxalate is separated by filtering, washed several times with water, dried, and pyrolysed in a reducing atmosphere at about 500° C. The product obtained is a cobalt powder with the desired grain size. The chemical impurities originate in the raw materials used. The carbon content for its part depends on the degree of decomposition of the oxalate. The grain growth and sintering of the cobalt powder set the limits for the maximum temperature and period which can be used. This production process has been used for decades, and its various stages are well known. The greatest weakness of the process is its high cost and the inevitable inclusion of a certain proportion of carbon in the cobalt.

Processes have been developed in which part or all of the oxalic acid is replaced by a less expensive reagent, such as carbonate. A complete carbonate precipitation demands, however, elevated pressure and temperature, i.e., an autoclave. If, on the other hand, only part of the oxalate is replaced by carbonate, it is not possible to produce a homogenous extra fine cobalt powder. In the carbonate decomposition the carbon content will be of the same order as in the oxalate process.

Carbon-free, finely-divided cobalt powder can be produced by pyrolysing either cobalt chloride directly or by reducing cobalt oxide made from cobalt chloride. When impure Ni- and Na-bearing cobalt chloride solution is used as the raw material, it is easier to separate the nickel by liquid-liquid extraction. The sodium can be washed with water from the cobalt oxide, which is the intermediate product. Pure cobalt chloride can naturally also be produced by leaching cobalt in hydrochloric acid, as in the oxalate process.

When fine cobalt powder is produced by the oxalate, carbonate or chloride process, the processes are multistage ones with both hydrometallurgical and pyrometallurgical operations.

SUMMARY OF THE INVENTION

We have now observed that extra fine cobalt with a grain size of 0.5-2 μm can be produced by starting from a cobalt (III) hexammine salt, from which a finely-divided and uniformly-grained cobalt oxide can be produced. The cobalt (III) hexammine salt is pyrolysed at a temperature in the range of 900°-1200° C. at preferably from 1000°-1100° C. to produce the cobalt oxide. The cobalt oxide produced is then comminuted to a particle size of from 1 to 5 μm. The oxide is then reduced, using hydrogen at a temperature of 450°-1000° C., preferably 450°-550° C. and most preferably 500°-550° C. and an extra fine cobalt powder is obtained as the product. We have observed that the fineness of cobalt oxide is a prerequisite for obtaining a finely-divided and uniformly-grained cobalt powder in the reduction.

EXAMPLE

Cobalt(III)hexammine sulphate, $[Co(NH_3)_6]_2(SO_4)_3 \cdot 2H_2O$ was pyrolysed for 2 hours in a chamber furnace at 1050° C. The product obtained was cobalt oxide with a specific surface area of 9400 $cm^2/g$. The oxide was loose powder. The oxide was reduced in a hydrogen atmosphere at 470° C. for two hours. The reduced product was cooled in a hydrogen atmosphere.

The analysis of the product was

Co>99.9 % by weight
Ni=0.006 % by weight
S>0.002 % by weight
Fe>0.001 % by weight
Mg>0.001 % by weight
Na>0.001 % by weight
Ca>0.001 % by weight
C>0.001 % by weight The average grain size of the powder was in the range 0.8-1.2 μm and its specific surface area was 2.1 $m^2/g$.

What is claimed is:

1. A process for the production of extra fine cobalt powder, comprising pyrolysing a cobalt(III)hexammine salt directly into its oxide, and then reducing the oxide to extra fine cobalt powder.

2. The process of claim 1, comprising pyrolysing cobalt(III)-hexammine sulfate.

3. The process of claim 1, in which the reduction is performed using hydrogen.

4. The process of claim 1, in which the cobalt(III)hexammine salt is pyrolysed at 900°-1200° C.

5. The process of claim 1, in which the cobalt(III)hexammine salt is pyrolysed at 1000°-1100° C.

6. The process of claim 1, in which the reduction is performed at 450°-1000° C.

7. The process of claim 1, in which the reduction is performed at 500°-550° C.

8. The process of claim 1, in which the obtained oxide is comminuted to a particle size of 1-5 μm before the reduction.

* * * * *

UNITED STATES PATENT AND TRADEMARK OFFICE

CERTIFICATE OF CORRECTION

PATENT NO. : 4,178,172

DATED : December 11, 1979

INVENTOR(S) : Tiitinen et al

It is certified that error appears in the above-identified patent and that said Letters Patent are hereby corrected as shown below:

Col. 1, line 13:

"he hard metal" should read --the hard metal--.

Col. 2, in each of lines 33 through 38:

" > " should be -- < --.

Signed and Sealed this

Twenty-fifth Day of March 1980

[SEAL]

Attest:

SIDNEY A. DIAMOND

Attesting Officer

Commissioner of Patents and Trademarks